US010104475B2

(12) United States Patent
Izumi et al.

(10) Patent No.: US 10,104,475 B2
(45) Date of Patent: Oct. 16, 2018

(54) LOUDSPEAKER MAGNETIC CIRCUIT AND LOUDSPEAKER EQUIPPED WITH SAME

(71) Applicant: Panasonic Intellectual Property Management Co., Ltd., Osaka (JP)

(72) Inventors: Yuuki Izumi, Kanagawa (JP); Satoshi Koura, Osaka (JP); Tomonori Shibuya, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/496,315

(22) Filed: Apr. 25, 2017

(65) Prior Publication Data

US 2017/0230755 A1 Aug. 10, 2017

Related U.S. Application Data

(63) Continuation of application No. PCT/JP2016/003820, filed on Aug. 23, 2016.

(30) Foreign Application Priority Data

Aug. 24, 2015 (JP) ..... 2015-164414

(51) Int. Cl.
*H04R 9/02* (2006.01)
*H04R 7/18* (2006.01)
*H04R 9/06* (2006.01)

(52) U.S. Cl.
CPC ..... *H04R 9/025* (2013.01); *H04R 7/18* (2013.01); *H04R 9/06* (2013.01); *H04R 2209/022* (2013.01); *H04R 2209/024* (2013.01)

(58) Field of Classification Search
CPC ..... H04R 9/025; H04R 9/06; H04R 7/18
(Continued)

(56) References Cited

U.S. PATENT DOCUMENTS

2012/0148085 A1* 6/2012 Omori ..... H04R 7/14 381/400
2014/0254860 A1* 9/2014 French ..... H04R 9/025 381/401

FOREIGN PATENT DOCUMENTS

JP 48-021520 3/1973
JP 52-020849 B 6/1977
(Continued)

OTHER PUBLICATIONS

International Search Report of PCT application No. PCT/JP2016/003820 dated Nov. 8, 2016.

*Primary Examiner* — Sunita Joshi
(74) *Attorney, Agent, or Firm* — Greenblum & Bernstein, P.L.C.

(57) ABSTRACT

A magnetic circuit includes: a magnet including a first and a second surface; a top plate disposed on the first surface; a bottom plate coupled magnetically with the second surface; and a yoke coupled magnetically with the bottom plate and disposed so as to protrude from the bottom plate along a first direction. The second surface is parallel to the first surface. The first and the second surfaces are magnetized. The yoke includes a magnetic pole face that opposes the top plate. In a portion where the magnetic pole face is formed, of the yoke, a magnetic saturation part is disposed to generate magnetic saturation. The magnetic saturation part has a shape in which an area of a cross section perpendicular to the first direction decreases with nearness to a tip of the yoke along the first direction.

4 Claims, 4 Drawing Sheets

(58) Field of Classification Search
USPC ..... 381/398
See application file for complete search history.

(56) References Cited

FOREIGN PATENT DOCUMENTS

| | | |
|---|---|---|
| JP | 59-193700 | 11/1984 |
| JP | 11-168797 | 6/1999 |
| JP | 2009-105745 | 5/2009 |
| WO | 2014/134711 | 9/2014 |

* cited by examiner

LOUDSPEAKER MAGNETIC CIRCUIT AND LOUDSPEAKER EQUIPPED WITH SAME

BACKGROUND

1. Technical Field

The present disclosure relates to magnetic circuits for electrodynamic loudspeakers for use in audio apparatuses, and to loudspeakers equipped with the magnetic circuits.

2. Description of the Related Art

For loudspeakers, setting of frequency bands is important. In particular, a full-range loudspeaker is required to have a wide frequency band ranging from lower frequencies to higher frequencies. Accordingly, for such loudspeakers, techniques have been used for extending their frequency bands up to high frequencies, as needed.

As a factor in narrowing the frequency band at higher frequencies of a loudspeaker, there is an increase in impedance at high frequencies of a magnetic circuit of the loudspeaker. Hence, in order to widen the frequency band at higher frequencies of the loudspeaker, it is necessary to reduce the increase in the impedance at high frequencies of the loudspeaker magnetic circuit and to prevent its sound pressures at higher frequencies from decreasing.

As a technique for reducing the increase in the impedance at high frequencies of loudspeaker magnetic circuits, a method is known in which an upper end portion of the center pole of the magnetic circuit is covered with a ring-shaped non-magnetic conductive cap, for example, a copper cap.

Note that Japanese Patent Unexamined Publication No. H11-168797 is known as document information on prior arts relating to the disclosure disclosed in the present application, for example.

SUMMARY

The present disclosure provides a loudspeaker magnetic circuit and a loudspeaker equipped with the magnetic circuit. The loudspeaker magnetic circuit is intended to reduce an increase in its impedance at high frequencies, while preventing its sound pressures from being decreasing.

The magnetic circuit according to the present disclosure includes a magnet, a top plate, a bottom plate, and a yoke. The magnet includes a first surface and a second surface. The second surface is parallel to the first surface. The first and the second surfaces are magnetized. The top plate is disposed on the first surface of the magnet. The bottom plate is coupled magnetically with the second surface of the magnet. The yoke is coupled magnetically with the bottom plate and disposed so as to protrude from the bottom plate along a first direction. The yoke includes a magnetic pole face that opposes the top plate. In a portion, of the yoke, where the magnetic pole face is formed, a magnetic saturation part which generates magnetic saturation is disposed. The magnetic saturation part has a shape in which an area of a cross section perpendicular to the first direction decreases with nearness to a tip of the yoke along the first direction. The bottom plate and the yoke may be formed in either a one-piece body or separate bodies.

In accordance with the present disclosure as described above, the magnetic saturation part, which is disposed in the portion of the yoke where the magnetic pole face is disposed, generates the magnetic saturation which can reduce its inductance, thereby reducing an increase in its impedance at high frequencies. The present disclosure can provide the loudspeaker magnetic circuit and the loudspeaker equipped with the magnetic circuit, which thereby allows an improvement in sound pressure levels, reduction in sound distortions, and extension in a high limit frequency of the loudspeaker.

DETAILED DESCRIPTION OF PREFERRED EMBODIMENTS

Prior to descriptions of embodiments of the present disclosure, problems of conventional magnetic circuits will be briefly described.

First, loudspeaker magnetic circuits in which their center poles are covered with non-magnetic conductive cap are not preferable in view of their manufacturing, because of an increased number of components, lowered productivity, etc.

Moreover, each of the loudspeaker magnetic circuits, having the center pole covered with the non-magnetic conductive cap, is required to have a large magnetic gap that is undesirably widened proportionately with a wall thickness of the non-magnetic conductive cap. This results in a drop in magnetic flux density in the magnetic gap. For this reason, the loudspeaker using such a magnetic circuit has disadvantages of a reduced level of sound pressures.

Hereinafter, the descriptions will be made regarding loudspeaker magnetic circuits according to the embodiments of the present disclosure, and loudspeakers equipped with the magnetic circuits, with reference to FIGS. 1 to 8.

First Exemplary Embodiment

Figure 1:
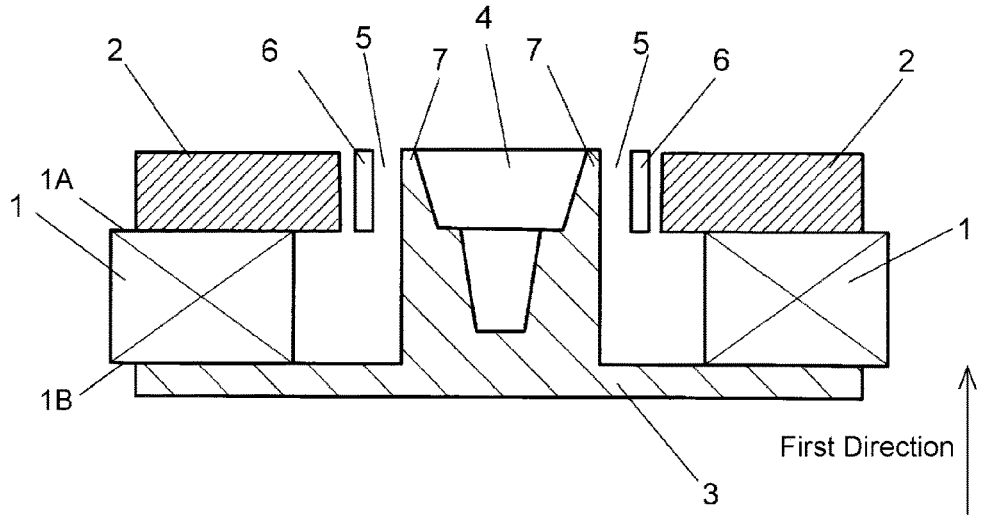
FIG. 1 is a cross-sectional view of a loudspeaker magnetic circuit according to a first embodiment of the present disclosure.
Figure 2:
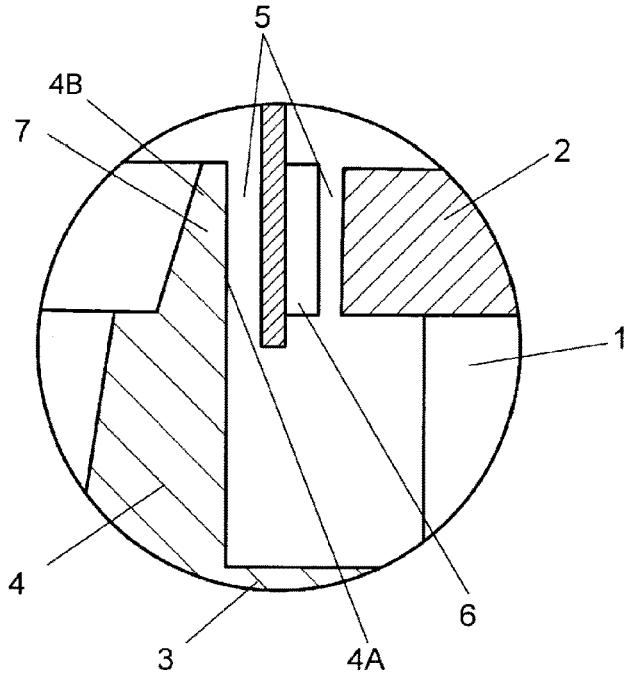
FIG. 2 is a cross-sectional view illustrating a principal part of FIG. 1.

FIG. 1 is a cross-sectional view of a loudspeaker magnetic circuit according to a first embodiment of the present disclosure; FIG. 2 is a cross-sectional view illustrating a principal part of FIG. 1.

The loudspeaker magnetic circuit is of an outer magnet-type. That is, the loudspeaker magnetic circuit includes: ring-shaped magnet 1, ring-shaped top plate 2, and disk-shaped bottom plate 3 which is integrally formed with center pole 4. Magnet 1 is a ferrite magnet which is magnetized in a direction of its up-and-down thickness. Then, magnet 1 is disposed on bottom plate 3. Top plate 2 is disposed on an upper surface of magnet 1. Bottom plate 3 is magnetically coupled with a lower surface of magnet 1. Center pole 4 protrudes to pass through a center hole of magnet 1. Magnetic gap 5 is formed between top plate 2 and center pole 4. In magnetic gap 5, voice coil 6 is disposed.

Top plate 2, bottom plate 3, and center pole 4 are made from a hot-rolled sheet steel (e.g. SPHC or SPHD grades in the Japanese Industrial Standards), for example.

Center pole 4, acting as a yoke that opposes top plate 2, forms magnetic gap 5 between the pole and top plate 2.

Center pole 4 is provided with a bottomed hole in its center portion. In an upper portion of center pole 4, magnetic saturation part 7 is formed on the opposite side from the magnetic gap 5 side. Such a magnetic saturation part has a reduced cross section, compared to the other parts on the bottom plate 3 side of center pole 4.

Magnetic saturation part 7 is disposed in the portion of center pole 4 where magnetic pole face 4A exposed to magnetic gap 5 is formed. Magnetic saturation part is formed in a stepped shape on the inner peripheral side of center pole 4 in such a manner that the wall thickness of center pole 4 is reduced by thinning the rear face on an opposite side of the center pole from magnetic pole face 4A. That is, magnetic saturation part 7 is disposed in center pole 4 at a position which lies on an extended line from top plate 2 toward magnetic gap 5. Magnetic saturation part 7 defines the region of an approximate magnetic pole width of magnetic gap 5.

In a case where bottom plate 3 and center pole 4 are formed by metal injection molding, for example, magnetic saturation part 7 as well is simultaneously formed together with them by the molding. In a case where bottom plate 3 and center pole 4 are formed not by molding, magnetic saturation part 7 is formed by cutting. Moreover, in a case where highly accurate dimensions are not particularly required, magnetic saturation part 7 may be formed by usual multistage forming.

In the loudspeaker magnetic circuit configured in this way, magnet 1 magnetizes top plate 2 and center pole 4 such that they are opposite in polarity. That is, top plate 2 is magnetized to one magnetic pole, e.g. N pole, while center pole 4 is magnetized to the other magnetic pole, i.e. S pole. Therefore, a magnetic flux is generated so as to pass from top plate 2 toward center pole 4. That is, in magnetic gap 5, the magnetic flux is generated in an approximately lateral direction on the paper sheet of the drawing.

On the other hand, voice coil 6 disposed in magnetic gap 5 is wound on bobbin 8 such that a drive current flows in a direction perpendicularly penetrating the paper sheet of the drawing. Accordingly, in magnetic gap 5, the thus-generated magnetic flux is effective to voice coil 6. Voice coil 6 is displaced in accordance with the direction of the drive current flowing through voice coil 6, in directions perpendicular to the direction of the effective magnetic flux in magnetic gap 5, namely, in the up-and-down directions of the paper sheet of the drawing.

In the loudspeaker magnetic circuit according to the first embodiment, magnetic saturation part 7 generates magnetic saturation in a magnetic path where the effective magnetic flux is generated in magnetic gap 5. Moreover, magnetic saturation part 7 is disposed in the portion of center pole 4 where magnetic pole face 4A exposed to magnetic gap 5 is formed in such a manner that magnetic saturation part 7 corresponds to the region of the approximate magnetic pole width. That is, the wall thickness of center pole 4 is reduced in a direction substantially perpendicular to the direction in which an alternating magnetic flux is generated by voice coil 6 when the drive current passes through voice coil 6. Magnetic fluxes which pass through a magnetic body are concentrated near a surface of the magnetic body by the skin effect, as the frequency of the alternating magnetic flux is higher. For this reason, magnetic saturation part 7 can effectively act to reduce an increase in inductance of voice coil 6. As a result, the loudspeaker is capable of keeping a high sound pressure level up to a high frequency range, resulting in preferable frequency response characteristics.

In this case, magnetic saturation part 7 is disposed in the portion of center pole 4 where magnetic pole face 4A of magnetic gap 5 is formed in such a manner that magnetic saturation part 7 corresponds to the region of the approximate magnetic pole width. Then, no other member such as a copper cap is disposed between magnetic pole face 4A and magnetic saturation part 7 that define magnetic gap 5. This allows appropriate setting of the magnetic pole width and gap distance of magnetic gap 5, despite of the presence of magnetic saturation part 7.

Moreover, magnetic saturation part 7 generates the magnetic saturation in the magnetic path where the effective magnetic flux is generated in magnetic gap 5. This can reduce a variation in magnetic flux density in comparison with the intensity of the alternating magnetic field generated by voice coil 6. That is, the magnetic field generated in magnetic gap 5 acts on the alternating magnetic field generated by voice coil 6 in a region of low magnetic permeability. Accordingly, magnetic saturation part 7 reduces a variation in the magnetic permeability in the alternating magnetic field generated by voice coil 6, thereby decreasing harmonic distortions (the third-order harmonic distortion, in particular).

Moreover, the magnetic saturation generated by magnetic saturation part 7 causes a leakage flux. Such a leakage flux leaks into magnetic gap 5 and acts as an effective magnetic flux in magnetic gap 5; therefore, this can reduce a drop in effective magnetic-flux density in magnetic gap 5. This is because magnetic saturation part 7 is disposed in the portion, of center pole 4, where magnetic gap 5 is formed such that magnetic saturation part 7 corresponds to the region of the approximate magnetic pole width.

As described above, the magnetic circuit according to the embodiment includes magnet 1, top plate 2, bottom plate 3, and center pole 4 that functions as a yoke. Magnet 1 includes: the upper surface serving as first surface 1A, and the lower surface serving as second surface 1B. Second surface 1B is located downward with respect to first surface 1A, and is parallel to first surface 1A. First surface 1A and second surface 1B are magnetized. Top plate 2 is disposed on first surface 1A of magnet 1. Bottom plate 3 is magnetically coupled with second surface 1B of magnet 1. Center pole 4 is magnetically coupled with bottom plate 3 and disposed so as to protrude from bottom plate 3 along a first direction. Center pole 4 includes magnetic pole face 4A that opposes top plate 2. In the portion of center pole 4 where magnetic pole face 4A is formed, magnetic saturation part 7 is disposed for generating the magnetic saturation. Magnetic saturation part 7 is of a shape in which an area of a cross section perpendicular to the first direction decreases with nearness to the tip of center pole 4 along the first direction.

Center pole 4 includes rear face 4B on the opposite side from magnetic pole face 4A. Then, rear face 4B is inclined with respect to magnetic pole face 4A, thereby forming magnetic saturation part 7.

Second Exemplary Embodiment

Figure 3:
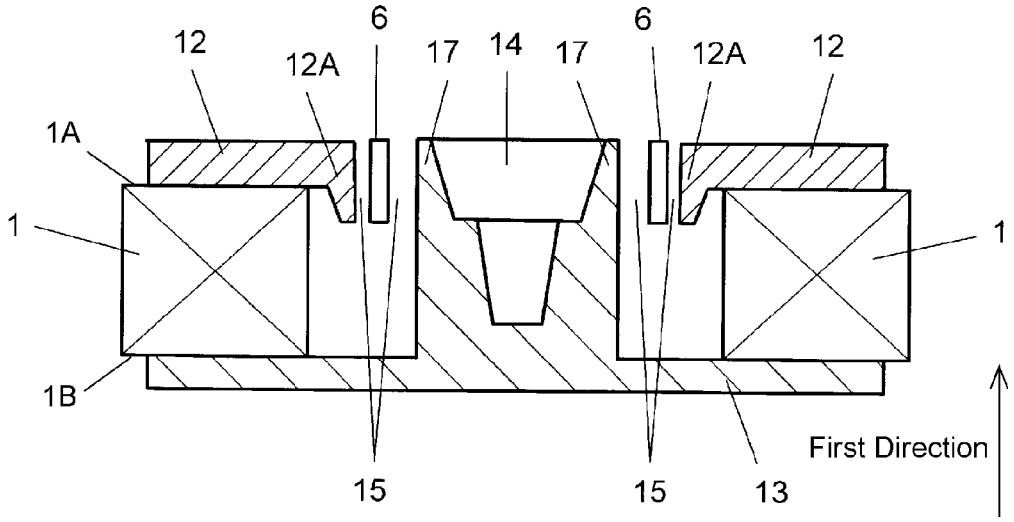
FIG. 3 is a cross-sectional view of a loudspeaker magnetic circuit according to a second embodiment of the present disclosure.
Figure 4:
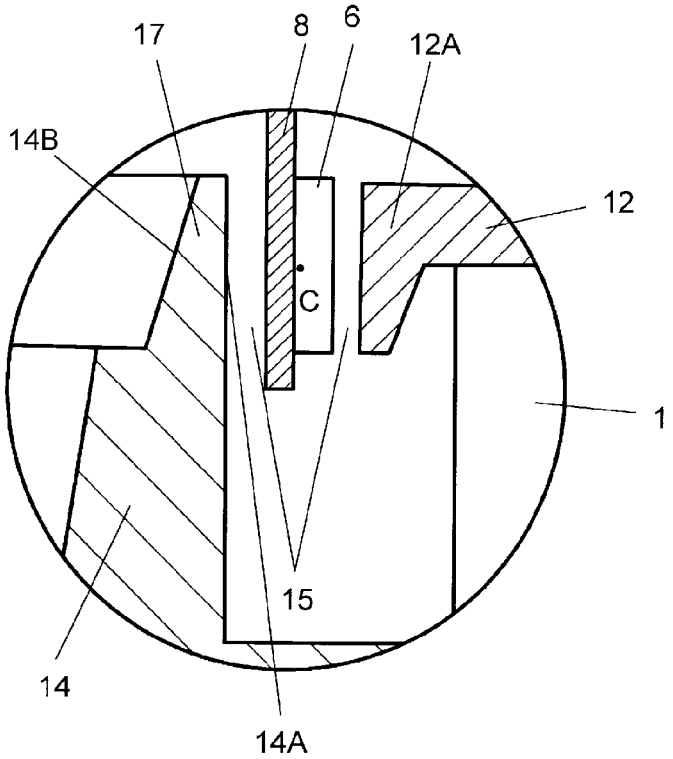
FIG. 4 is a cross-sectional view illustrating a principal part of FIG. 3.

FIG. 3 is a cross-sectional view of a loudspeaker magnetic circuit according to a second embodiment of the present disclosure. FIG. 4 is a cross-sectional view illustrating a principal part of FIG. 3. In FIGS. 3 and 4, the same constituent elements as those of FIGS. 1 and 2 are designated by the same numerals.

The loudspeaker magnetic circuit according to the embodiment is different from that according to the first embodiment in that top plate 12 has a different shape. Moreover, center pole 14 has a low profile which is lowered according to a reduction in thickness of a portion, of top plate 12, disposed on magnet 1.

As in the case of the loudspeaker magnetic circuit according to the first embodiment, center pole 14 is provided with a bottomed hole in its center portion. Then, in an upper portion of center pole 14, magnetic saturation part 17 is formed on the opposite side of the upper portion from the magnetic gap 15 side. Magnetic saturation part 17 has a shape in which an area of a cross section is smaller at a greater distance away from bottom plate 13 to the end portion of the center pole.

Magnetic saturation part 17 is disposed in a portion, of center pole 14, where magnetic pole face 14A of magnetic gap 15 is formed, by recessing the inner peripheral side of center pole 14 to have a stepped shape. That is, magnetic saturation part 17 is disposed in such a manner that the wall thickness of center pole 14 is reduced by thinning the rear face on an opposite side of the center pole from magnetic pole face 14A. Magnetic saturation part 17 generates magnetic saturation in a magnetic path where an effective magnetic flux is generated in magnetic gap 15.

The thickness of top plate 12 is smaller than the magnetic pole width of magnetic gap 15. However, magnetic pole part 12A is extended to protrude downward in order to provide an adequate dimension of the magnetic pole width of magnetic gap 15 so as to correspond to a winding width of voice coil 6. Magnetic pole part 12A of top plate 12 is formed in a tapered shape toward its tip, serving as a second magnetic saturation part to generate magnetic saturation. Accordingly, magnetic pole part 12A reduces a variation in magnetic permeability in an alternating magnetic field generated by voice coil 6, thereby effectively acting to reduce an increase in inductance of voice coil 6 and to reduce the third-order harmonic distortion.

Furthermore, in their cross sections, magnetic pole part 12A of top plate 12 is formed to have point symmetry or approximate point symmetry with magnetic saturation part 17 of center pole 14, around the center of magnetic gap 15 as central point C. Therefore, the magnetic saturation generated in both magnetic saturation part 17 and magnetic pole part 12A causes a leakage flux in magnetic gap 15, and the distribution of the leakage flux is adjusted such that the leakage flux is effective to a magnetic flux in magnetic gap 15. This can eliminate an imbalance in the magnetic-flux density distribution over the entire magnetic pole width of magnetic gap 15, resulting in a reduction of asymmetry of the magnetic-flux density distribution in magnetic gap 15. A magnetic field analysis has confirmed that this configuration allows the magnetic flux density in magnetic gap 15 to be more uniform so that the asymmetry of the magnetic-flux density in magnetic gap 15 is reduced. With this configuration, when the center of magnetic gap 15 is aligned with or positioned closer to the center of voice coil 6, the uniformity of intensity of the magnetic flux in magnetic gap 15 improves, where the magnetic flux acts on the drive signal that passes through voice coil 6.

Accordingly, the magnetic saturation generated by both magnetic saturation part 17 and magnetic pole part 12A brings about the adjustment of distribution of the leakage flux that leaks into magnetic gap 15. This can eliminate the imbalance in the magnetic-flux density distribution over the entire magnetic pole width of magnetic gap 15, resulting in a reduction of asymmetry of the magnetic-flux density distribution in magnetic gap 15. The loudspeaker magnetic circuit provided with magnetic pole part 12A, serving as the second magnetic saturation part, in top plate 12 can achieve a reduction in the second-order harmonic distortion.

As described above, the magnetic circuit according to the embodiment includes magnet 1, top plate 12, bottom plate 13, and center pole 14 that functions as a yoke. Top plate 12 is disposed on first surface 1A of magnet 1. Bottom plate 13 is magnetically coupled with second surface 1B of magnet 1. Center pole 14 is magnetically coupled with bottom plate 13 and disposed so as to protrude from bottom plate 3 along a first direction. Center pole 14 includes magnetic pole face 14A that opposes top plate 12. In the portion, of center pole 14, where magnetic pole face 14A is formed, magnetic saturation part 17 is disposed for generating the magnetic saturation. Magnetic saturation part 17 has a shape in which an area of a cross section perpendicular to the first direction decreases with nearness to the tip of center pole 14 along the first direction.

Center pole 14 includes rear face 14B on the opposite side from magnetic pole face 14A. Then, rear face 14B is inclined with respect to magnetic pole face 14A, which thereby forms magnetic saturation part 17.

Top plate 12 includes magnetic pole part 12A that opposes center pole 14. The thickness of a portion which in disposed on first surface 1A of magnet 1, of top plate 12 is smaller than the length of magnetic pole part 12A in the first direction.

Top plate 12 is formed in a tapered shape toward its tip, serving as the second magnetic saturation part to generate the magnetic saturation.

In their cross sections, magnetic pole part 12A and magnetic saturation part 17 are formed to have point symmetry or approximate point symmetry with each other, around the center of magnetic gap 15 as the central point of symmetry.

Third Exemplary Embodiment

Figure 5:
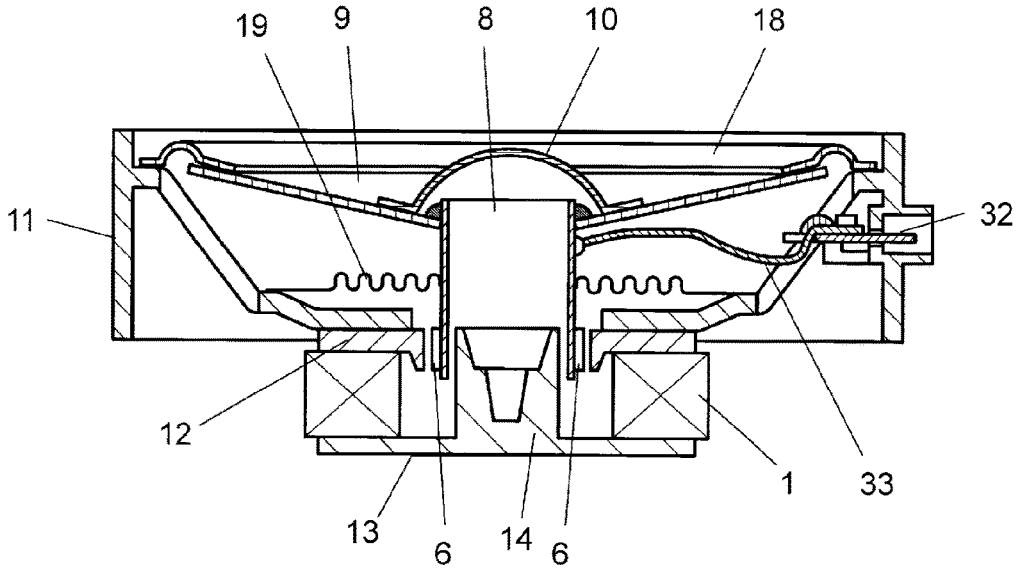
FIG. 5 is a cross-sectional view of a loudspeaker equipped with the loudspeaker magnetic circuit shown in FIG. 3, according to a third embodiment of the present disclosure.

FIG. 5 is a cross-sectional view of a loudspeaker according to a third embodiment of the present disclosure, that is, an example of a loudspeaker equipped with the loudspeaker magnetic circuit according to the second embodiment. In FIG. 5, the same constituent elements as those of FIGS. 3 and 4 are designated by the same numerals, and their descriptions are omitted.

In the loudspeaker, voice coil 6 is wound on cylindrical bobbin 8, and a center portion of diaphragm 9 is fixed to bobbin 8. Center cap 10, having a domed shape, is bonded to diaphragm 9 so as to close a center opening of diaphragm 9, thereby protecting magnetic gap 5 against dust coming in. Frame 11 surrounds the periphery and back of diaphragm 9 and a lower end of frame 11 is fixed to the upper surface of top plate 12. An outer peripheral end of diaphragm 9 is fixed to one end of edge 18. The other end of edge 18 is fixed to frame 11. Bobbin 8 is fixed to one end of damper 19. The other end of damper 19 is fixed to frame 11. Edge 18 and damper 19 serve together as a suspension to support diaphragm 9 on frame 11 displaceably in the anterior-posterior directions (the up-and-down directions of the paper sheet of the drawing) of diaphragm 9. Such anterior-posterior directions are perpendicular to the direction of the magnetic flux in magnetic gap 15.

Terminals 32 fixed to frame 11 are fed with a drive signal to drive the loudspeaker. Then, the drive signal is fed to voice coil 6 via tinsel wires 33. Upon feeding the drive signal to voice coil 6, bobbin 8 is driven in response to the direction and magnitude of the drive signal, in a direction perpendicular to the direction of the effective magnetic flux in magnetic gap 15. Therefore, diaphragm 9 is driven in the anterior-posterior directions (the up-and-down directions of the paper sheet of the drawing) of diaphragm 9.

The loudspeaker configured in this way provides the magnetic saturation that is generated by both magnetic saturation part 7 of center pole 14 and magnetic pole part 12A of top plate 12. Accordingly, the increase in inductance of voice coil 6 is suppressed, leading to good frequency response characteristics up to high frequencies of the loudspeaker. Moreover, the loudspeaker can achieve a reduction in harmonic distortions, resulting in reduced distortions at mid and high frequencies.

Moreover, magnetic saturation part 7 is located at a part which is not affected by the magnetic pole width and gap distance of magnetic gap 5. Then, the leakage flux from both magnetic saturation part 7 and magnetic pole part 12A of top plate 12 acts as an effective magnetic flux in magnetic gap 5. Such an effective magnetic flux can be effectively used to prevent sound pressures of the loudspeaker from decreasing.

The applicant conducted a comparative experiment of loudspeakers. The loudspeakers compared in the experiment are as follows: A loudspeaker according to the embodiment, which is equipped with the magnetic circuit including magnetic saturation part 7 and magnetic pole part 12A configured as described above; a loudspeaker with a copper cap, which is equipped with a magnetic circuit having a center pole of which upper end portion is covered with the copper cap; and a conventional loudspeaker which is equipped with a conventional magnetic circuit. The result of the comparative experiment has shown that, concerning their impedance at 20 kHz, the loudspeaker according to the embodiment has lower impedance than the conventional one by 8.8Ω, while the loudspeaker with the copper cap has lower impedance than the conventional one by 14Ω. In the impedance at 20 kHz, the loudspeaker according to the embodiment is not so effective in reducing the impedance as the loudspeaker with the copper cap. Fortunately, the loudspeaker according to the embodiment has no difference from the loudspeaker with the copper cap in frequency dependence at frequencies up to 6 kHz or 7 kHz. Concerning their average sound-pressure levels at low and mid frequencies of 300 Hz, 400 Hz, 500 Hz, and 600 Hz, the loudspeaker according to the embodiment has been confirmed to have no difference from the conventional one, while the loudspeaker with the copper cap has been confirmed to have a lower level than the conventional one by approximately 1 dB. That is, in their average sound-pressure levels at the low and mid frequencies, the loudspeaker according to the embodiment is approximately 1 dB higher in level than the loudspeaker with the copper cap.

The frequency dependence of the loudspeaker according to the embodiment is not so great as that of the loudspeaker with the copper cap. Therefore, in reducing both the third-order harmonic distortion and the increase in impedance, the loudspeaker according to the embodiment is more greatly effective than the loudspeaker with the copper cap at frequencies up to 6 kHz or 7 kHz.

Fourth Exemplary Embodiment

Figure 6:
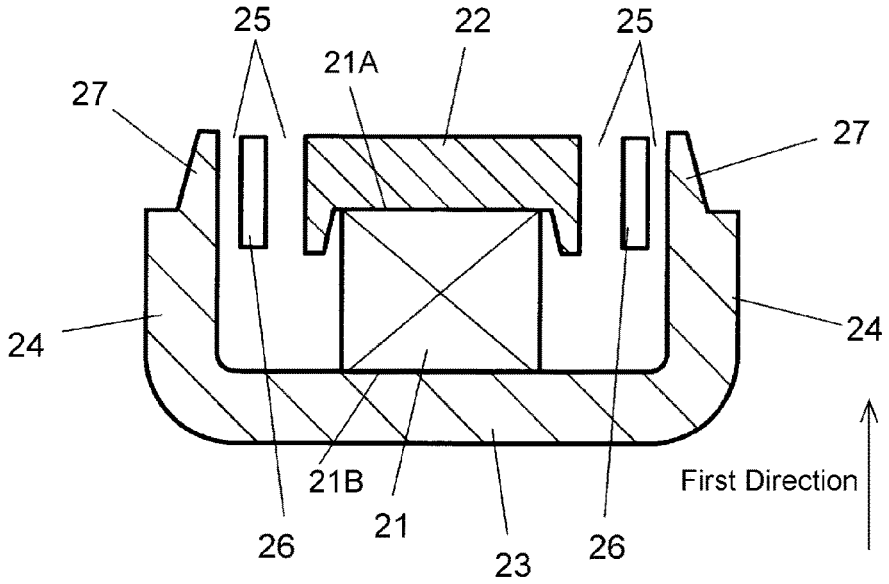
FIG. 6 is a cross-sectional view of a loudspeaker magnetic circuit according to a fourth embodiment of the present disclosure.
Figure 7:
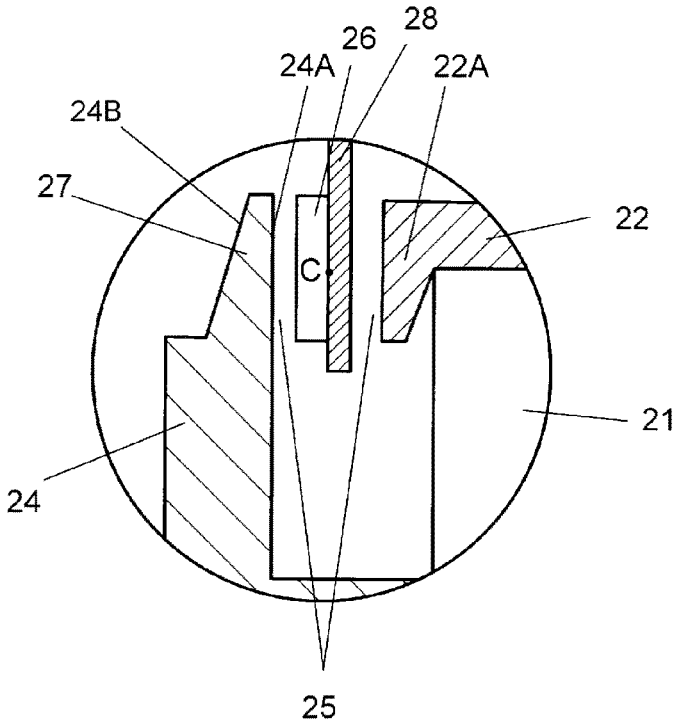
FIG. 7 is a cross-sectional view illustrating a principal part of FIG. 6.

FIG. 6 is a cross-sectional view of a loudspeaker magnetic circuit according to a fourth embodiment of the present disclosure. FIG. 7 is a cross-sectional view illustrating a principal part of FIG. 6.

The loudspeaker magnetic circuit is of an inner magnet-type. That is, the loudspeaker magnetic circuit includes circular column-shaped magnet 21, disk-shaped top plate 22, and bottom plate 23 which is integrally formed with yoke 24. Magnet 21 is a neodymium-based magnet which is magnetized in a direction of its up-and-down thickness. Top plate 22 is disposed on an upper surface of magnet 21. Bottom plate 23 is formed in a bottomed cylinder shape. On the bottom of the bottom plate, magnet 21 is disposed. The bottom plate is magnetically coupled with the lower surface of magnet 21. Yoke 24 is formed in a cylinder shape protruding from the bottom so as to surround both magnet 21 and top plate 22. Between top plate 22 and yoke 24, magnetic gap 25 is provided. In magnetic gap 25, voice coil 26 is disposed which is wound on bobbin 28.

An upper portion of yoke 24 acts as a counter yoke that opposes top plate 22, and forms magnetic gap 25 together with top plate 22 therebetween.

In the upper portion of yoke 24, magnetic saturation part 27 is formed on the opposite side of the upper portion from the magnetic gap 25 side. Magnetic saturation part 27 has a reduced cross section, compared to the other parts on the bottom plate 23 side of yoke 24. Magnetic saturation part 27 is formed in a stepped shape on the outer peripheral side of yoke 24 so as to generate magnetic saturation.

Magnetic saturation part 27 is disposed in a portion where magnetic pole face 24A of magnetic gap 25 is formed, of yoke 24, in such a manner that the wall thickness of yoke 24 is reduced by thinning the rear face on an opposite side of the yoke from magnetic pole face 24A. That is, magnetic saturation part 27 is disposed in yoke 24 at a position which lies on an extended line from top plate 22 toward magnetic gap 25. Magnetic saturation part 27 corresponds to the region of a magnetic pole width of magnetic gap 25.

The thickness of top plate 22 is smaller than the magnetic pole width of magnetic gap 25. Magnetic pole part 22A is extended to protrude downward in order to allow an adequate dimension of the magnetic pole width of magnetic gap 25 such that the magnetic pole width corresponds to a winding width of voice coil 26. Magnetic pole part 22A of top plate 22 is formed in a tapered shape in which the cross section area decreases with nearness to the tip of magnetic pole part 22A, thereby serving as a second magnetic saturation part to generate magnetic saturation in top plate 22.

Then, in their cross sections, magnetic pole part 22A of top plate 22 is formed to have point symmetry or approximate point symmetry with magnetic saturation part 27 of yoke 24, around the center of magnetic gap 25 as central point C. Therefore, the distribution of a leakage flux in magnetic gap 25 caused via the magnetic saturation that is generated by both magnetic saturation part 27 and magnetic pole part 22A is adjusted such that the leakage flux can act effectively.

In the inner-magnet-type loudspeaker magnetic circuit configured in this way according to the fourth embodiment, magnetic saturation part 27 generates the magnetic saturation in a magnetic path where an effective magnetic flux is generated in magnetic gap 25, as in the cases of the outer-magnet-type loudspeaker magnetic circuits according to the first and second embodiments.

Furthermore, magnetic saturation part 27 is disposed in a portion, of yoke 24, where magnetic pole face 24A of magnetic gap 25 is formed, such that magnetic saturation part 27 corresponds to the region of the magnetic pole width. Magnetic saturation part 27 is formed such that its wall thickness is reduced in a direction that is approximately perpendicular to the direction in which an alternating magnetic flux is generated by voice coil 26 when a drive signal passes through voice coil 26. Magnetic fluxes passing through a magnetic substance are concentrated near a surface of the magnetic body by the skin effect, as the frequency of the alternating magnetic flux is higher. For this reason, magnetic saturation part 27 can effectively act to reduce an increase in inductance of voice coil 26.

In this case, magnetic saturation part 27 is disposed in the portion of yoke 24 where magnetic pole face 24A of magnetic gap 25 is formed in such a manner that magnetic saturation part 27 corresponds to the region of the magnetic pole width. Then, no other member such as a copper cap is disposed between magnetic pole face 24A and magnetic saturation part 27 that define magnetic gap 25. This allows appropriate setting of the magnetic pole width and gap distance of magnetic gap 25, despite of the presence of magnetic saturation part 27.

Moreover, magnetic saturation part 27 generates the magnetic saturation in the magnetic path where the effective magnetic flux is generated in magnetic gap 25. On the other hand, magnetic pole part 22A of top plate 22 is formed in a tapered shape toward its tip, so that magnetic pole part 22A is thinner in wall thickness than a body portion of top plate 22. This configuration causes magnetic pole part 22A to generate the magnetic saturation in the magnetic path where an effective magnetic flux is generated in magnetic gap 25. Then, both magnetic saturation part 27 and magnetic pole part 22A reduce a variation in magnetic permeability in an alternating magnetic field generated by voice coil 26, thereby effectively acting to reduce the increase in inductance of voice coil 26 and to reduce the third-order harmonic distortion.

Furthermore, magnetic saturation part 27 is disposed in the portion of yoke 24 where magnetic gap 25 is formed such that magnetic saturation part 27 corresponds to the region of the approximate magnetic pole width. Therefore, the leakage flux generated by magnetic saturation part 27 leaks into magnetic gap 25 to act as an effective magnetic flux in magnetic gap 25. This reduces a drop in effective magnetic-flux density in magnetic gap 25.

Moreover, the leakage flux leaking into magnetic gap 25 from both magnetic saturation part 27 and magnetic pole part 22A of top plate 22 is adjusted so as to be effectively used in magnetic gap 25. Therefore, the leakage flux can eliminate an imbalance in a magnetic-flux density distribution over the entire magnetic pole width of magnetic gap 25, which thereby reduces asymmetry of the magnetic-flux density distribution in magnetic gap 25. This configuration can achieve a reduction in the second-order harmonic distortion.

As described above, the magnetic circuit according to the embodiment includes magnet 21, top plate 22, bottom plate 23, and yoke 24. Top plate 22 is disposed on first surface 21A of magnet 21. Bottom plate 23 is magnetically coupled with second surface 21B of magnet 21. Yoke 24 is magnetically coupled with bottom plate 23 and is disposed so as to protrude from bottom plate 23 along a first direction. Yoke 24 includes magnetic pole face 24A that opposes top plate 22. In the portion of yoke 24 where magnetic pole face 24A is formed, magnetic saturation part 27 is disposed to generate the magnetic saturation. Magnetic saturation part 27 is of a shape in which an area of a cross section perpendicular to the first direction decreases toward the tip of yoke 4 along the first direction.

Yoke 24 includes rear face 24B on the opposite side from magnetic pole face 24A. Then, rear face 24B is inclined with respect to magnetic pole face 24A, which thereby forms magnetic saturation part 27.

Top plate 22 includes magnetic pole part 22A that opposes yoke 24. The thickness of a portion disposed on first surface 21A of magnet 21, of top plate 22, is smaller than the length of magnetic pole part 22A in the first direction.

Magnetic pole part 22A is formed in a tapered shape toward its tip, serving as the second magnetic saturation part to generate the magnetic saturation.

In their cross sections, magnetic saturation part 27 and magnetic pole part 22A are formed to have point symmetry or approximate point symmetry with each other, around the center of magnetic gap 25 as the central point of symmetry.

Fifth Exemplary Embodiment

Figure 8:
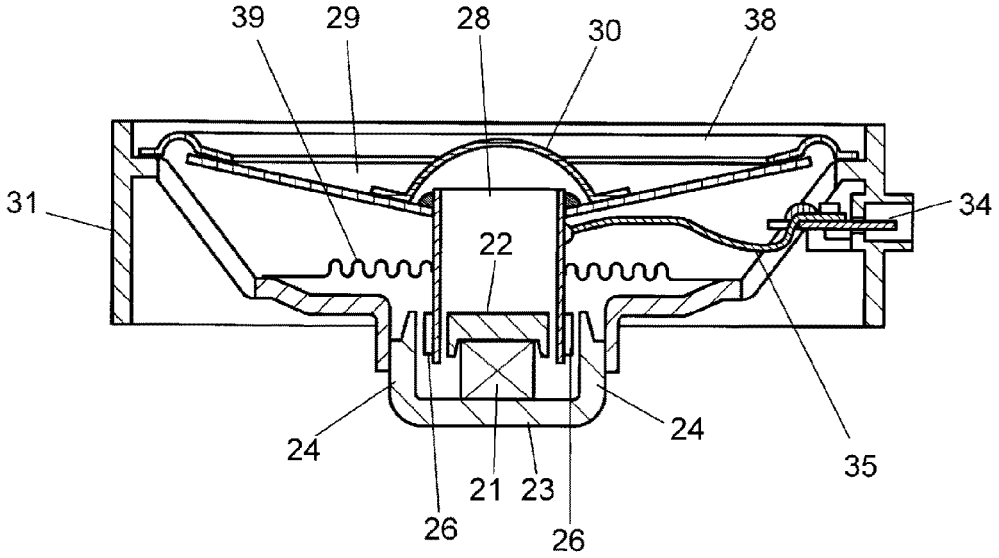
FIG. 8 is a cross-sectional view of a loudspeaker equipped with the loudspeaker magnetic circuit shown in FIG. 6, according to a fifth embodiment of the present disclosure.

FIG. 8 is a cross-sectional view of a loudspeaker according to a fifth embodiment of the present disclosure, that is, an example of a loudspeaker equipped with the loudspeaker magnetic circuit according to the fourth embodiment. In FIG. 8, the same constituent elements as those of FIGS. 6 and 7 are designated by the same numerals, and their descriptions are omitted.

In the loudspeaker, voice coil 26 is wound on cylindrical bobbin 28, and a center portion of diaphragm 29 is fixed to bobbin 28. Center cap 30, having a domed shape, is bonded to diaphragm 29 so as to close a center opening of diaphragm 29, thereby protecting magnetic gap 25 against dust coming in. A lower end of frame 31 is fixed to the outer peripheral side surface of yoke 24 such that frame 31 surrounds the periphery and back of diaphragm 29. An outer peripheral end of diaphragm 29 is fixed to one end of edge 38. The other end of edge 38 is fixed to frame 31. Bobbin 28 is fixed to one end of damper 39. The other end of damper 39 is fixed to frame 31. Diaphragm 29 is supported on frame 31 via a suspension configured of edge 38 and damper 39, displaceably in the anterior-posterior directions (the up-and-down directions of the paper sheet of the drawing) of diaphragm 29. Such anterior-posterior directions are perpendicular to the direction of the magnetic flux in magnetic gap 25.

A drive signal to drive the loudspeaker is fed to terminals 34 fixed to frame 31. Then, the drive signal is fed to voice coil 26 via tinsel wires 35. Upon feeding the drive signal to voice coil 26, bobbin 28 is driven in response to the direction and magnitude of the drive signal, in a direction perpendicular to the direction of the effective magnetic flux in magnetic gap 25. Therefore, diaphragm 29 is driven in the anterior-posterior directions (the up-and-down directions of the paper sheet of the drawing) of diaphragm 29.

The loudspeaker configured in this way can reduce an increase in inductance of voice coil 26, thanks to magnetic saturation part 27 of yoke 24 and magnetic pole part 22A of top plate 22. This brings about good frequency response characteristics up to high frequencies. Moreover, the loudspeaker can achieve a reduction in harmonic distortions, resulting in reduced distortions at mid and high frequencies. Furthermore, as magnetic saturation part 27 is formed in yoke 24, the magnetic saturation part is not affected by the magnetic pole width and gap distance of magnetic gap 25. For this reason, the leakage flux from both magnetic saturation part 27 of yoke 24 and magnetic pole part 22A of top plate 22 is allowed to act as an effective magnetic flux in magnetic gap 25, thereby preventing sound pressures of the loudspeaker from decreasing.

It is noted that the various embodiments described above are intended to facilitate easy understanding of the present disclosure and, therefore, are not intended to be construed as limiting the present disclosure. Consequently, various modifications may be made to the materials and shapes of the various constituent elements that configure the loudspeaker magnetic circuits and the loudspeakers equipped with the magnetic circuits that have been described in the embodiments.

The present disclosure may be modified and improved without departing from the gist of the disclosure, and the equivalents thereof are included in the present disclosure.

The loudspeaker magnetic circuits according to the present disclosure and the loudspeakers equipped with the magnetic circuits are applicable to automotive audio apparatuses and household audio apparatuses, and are useful to reduce an increase in their impedance at high frequencies, while preventing their sound pressures from decreasing.

What is claimed is:

1. A loudspeaker magnetic circuit comprising:

a magnet including:

a magnetized first surface; and a magnetized second surface disposed parallel to the first surface;

a top plate disposed on the first surface of the magnet;

a bottom plate magnetically coupled with the second surface of the magnet; and a yoke magnetically coupled with the bottom plate and disposed so as to protrude from the bottom plate along a first direction, the yoke including a magnetic pole face opposing the top plate, the magnetic pole face being disposed in a portion of the yoke, wherein a magnetic gap is provided between the top plate and the yoke, a magnetic saturation part generating magnetic saturation is disposed in the portion of the yoke, the magnetic saturation part is trapezoidal and has a shape in which an area of a cross section perpendicular to the first direction decreases with nearness to a tip of the yoke along the first direction, the yoke further includes a rear face on an opposite side of the yoke from the magnetic pole face, the magnetic saturation part is formed by inclining the rear face with respect to the magnetic pole face, the top plate includes:

a magnetic pole part opposing the yoke; and a portion disposed on the first surface of the magnet, a thickness of the portion of the top plate on the first surface of the magnet is smaller than a thickness of the magnetic pole part in the first direction, the magnetic pole part of the top plate is an innermost portion of the top plate, extends from a bottommost surface of the top plate in the first direction to a topmost surface of the top plate in the first direction, is trapezoidal, has a shape in which an area of a cross section perpendicular to the first direction increases with nearness to the topmost surface of the top plate along the first direction, and is a second magnetic saturation part generating magnetic saturation, and cross-sections of the magnetic saturation part and the magnetic pole part in the first direction have point symmetry or approximate point symmetry with respect to a center of the magnetic gap as a central point.

2. A loudspeaker magnetic circuit, comprising:

a magnet including:

a magnetized first surface; and a magnetized second surface disposed parallel to the first surface;

a top plate disposed on the first surface of the magnet;

a bottom plate magnetically coupled with the second surface of the magnet; and a yoke magnetically coupled with the bottom plate and disposed so as to protrude from the bottom plate along a first direction, the yoke including a magnetic pole face opposing the top plate, the magnetic pole face being disposed in a portion of the yoke, wherein a magnetic gap is provided between the top plate and the yoke, a magnetic saturation part generating magnetic saturation is disposed in the portion of the yoke, the magnetic saturation part is trapezoidal and has a shape in which an area of a cross section perpendicular to the first direction decreases with nearness to a tip of the yoke along the first direction, the top plate includes:

a magnetic pole part opposing the yoke; and a portion disposed on the first surface of the magnet, a thickness of the portion of the top plate on the first surface of the magnet is smaller than a thickness of the magnetic pole part in the first direction, the magnetic pole part of the top plate is an innermost portion of the top plate, extends from a bottommost surface of the top plate in the first direction to a topmost surface of the top plate in the first direction, is trapezoidal, has a shape in which an area of a cross section perpendicular to the first direction increases with nearness to the topmost surface of the top plate along the first direction, and is a second magnetic saturation part generating magnetic saturation, and cross-sections of the magnetic saturation part and the magnetic pole part in the first direction have point symmetry or approximate point symmetry with respect to a center of the magnetic gap as a central point.

3. A loudspeaker comprising:

the loudspeaker magnetic circuit according to claim 1;

a frame fixed to the loudspeaker magnetic circuit;

a bobbin disposed in the magnetic gap disposed between the top plate and the yoke;

a voice coil wound on the bobbin and disposed in the magnetic gap, displaceably along the first direction; and a diaphragm fixed to the bobbin and supported by a suspension displaceably in the first direction with respect to the frame.

4. A loudspeaker comprising:

the loudspeaker magnetic circuit according to claim 2;

a frame fixed to the loudspeaker magnetic circuit;

a bobbin disposed in the magnetic gap disposed between the top plate and the yoke;

a voice coil wound on the bobbin and disposed in the magnetic gap, displaceably along the first direction; and a diaphragm fixed to the bobbin and supported by a suspension displaceably in the first direction with respect to the frame.

* * * * *